United States Patent [19]

Meinherz et al.

[11] Patent Number: 4,490,595

[45] Date of Patent: Dec. 25, 1984

[54] ELECTRIC DISCONNECT OR GROUNDING SWITCH HAVING A MOVABLE SWITCH BLADE

[75] Inventors: Manfred Meinherz; Jorg Tietze, both of Berlin, Fed. Rep. of Germany

[73] Assignee: Siemens Aktiengesellschaft, Munich, Fed. Rep. of Germany

[21] Appl. No.: 464,898

[22] Filed: Feb. 8, 1983

[30] Foreign Application Priority Data

Feb. 8, 1982 [DE] Fed. Rep. of Germany ..... 3204438

[51] Int. Cl.[3] ..... H01H 1/42

[52] U.S. Cl. ..... 200/254; 200/255; 200/162

[58] Field of Search ..... 200/254, 255, 256, 162, 200/48 KB, 16 F

[56] References Cited

U.S. PATENT DOCUMENTS

| | | | |
|---|---|---|---|
| 1,031,031 | 7/1912 | Walker | 200/254 |
| 2,544,788 | 3/1951 | Hindman | 200/255 X |
| 3,127,491 | 3/1964 | Gorman | 200/254 |
| 3,410,974 | 11/1968 | Kussmaul | 200/255 X |
| 4,342,889 | 8/1982 | Welter | 200/255 X |

FOREIGN PATENT DOCUMENTS 1406173 9/1975 United Kingdom .

*Primary Examiner*—Stephen Marcus
*Assistant Examiner*—Ernest G. Cusick
*Attorney, Agent, or Firm*—Kenyon & Kenyon

[57] ABSTRACT

An electric disconnect or grounding switch is disclosed. The switch comprises a switch blade movable about a fulcrum and a fixed blade contact having a central slot open at one end to define resilient side walls which form spaced fixed contacts. The switch blade in the open position of the switch is parallel or at an angle to the blade contact. During closing of the switch, the switch blade enters the central slot from the closed end thereof and moves to the region of the current contacts until it comes into contact with an insulating stop disposed underneath the blade contact. There, motion of the switch blade is stopped and the switch blade is disposed perpendicular to the blade contact in the closed position of the switch.

2 Claims, 2 Drawing Figures

ELECTRIC DISCONNECT OR GROUNDING SWITCH HAVING A MOVABLE SWITCH BLADE

BACKGROUND OF THE INVENTION

The invention relates to an electric disconnect or grounding switch having a switch blade movable about a fulcrum into a stationary blade contact having a slot open on one side.

Disconnect switches of the above type are generally known. See, for example, British Pat. No. 1,406,173, particularly FIGS. 12 to 15 thereof. In the open condition of the disconnect or grounding switch, the movable switch blade is approximately parallel to the stationary blade contact, and the fulcrum about which the switch blade is moved is located above or below the region of the current contacts of the blade contact. Rotation of the switch blade when the switch is being closed moves the free end of the switch blade toward the blade contact and into the central slot thereof through the open end of the central slot. Rotation continues until the switch blade reaches the switch end position in the vicinity of the current contacts of the blade contact and comes to rest in a position perpendicular to the blade contact. Because of the position of the switch blade relative to the blade contact, forces are generated when current flows through the switch which urge the switch blade out of the blade contact. The blade contact is also open adjacent the current contacts thereof between which the blade contact comes to rest. Since the blade contact is open at the end adjacent the contacts, it offers little resistance, namely, only the friction of the free end current contacts, to the switch blade. As a result, it is possible, particularly in the event of a short circuit, that the forces generated by the current flow exceed the friction forces of the current contacts resiliently urged against the switch blade and force the switch blade out of the blade contact. For this reason, external locking devices are sometimes provided.

OBJECTS AND SUMMARY OF THE INVENTION

It is therefore an object of the present invention to prevent the switch blade in an electric disconnect or grounding switch having a blade contact connection from being pushed out of the blade contact by forces generated by current flows, particularly in the event of short circuits.

The above and other objects are achieved in accordance with the invention which provides an electric disconnect or grounding switch of the type described above in which the switch blade in the open position of the switch is parallel or at an angle with the fixed blade contact and, during closing of the switch, the blade is introduced into the slot from the closed end thereof and is guided to the vicinity of the current contacts. An insulating stop is arranged below the blade contact, against which the switch blade comes to rest in the closed position of the switch. The switch blade is not located, as was customary heretofore, to the side of the blade contact which faces away from the fulcrum in the open position of the disconnect or grounding switch, but the blade contact and the switch blade are approximately opposite each other, i.e., they are at an angle to each other, or on top or below each other, or side by side. During switching movement of the switch blade, a reversal in the direction of rotation of the switch blade relative to the position of the fixed blade contact occurs as the switch blade enters the central slot of the blade contact from its closed side. The stop with which the switch blade makes contact in the closed condition of the switch is arranged below the blade contact and beyond the change of direction of the switch blade. Accordingly, the stop prevents the switch blade from rotating out of the contact due to forces occurring because of a current loop effect. In addition, the stop, made of insulating material, provides a further support of the blade contact, so that the latter cannot be bent.

The above and other objects, features, aspects and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which.

DESCRIPTION OF THE PREFERRED EMBODIMENT

Figure 1:
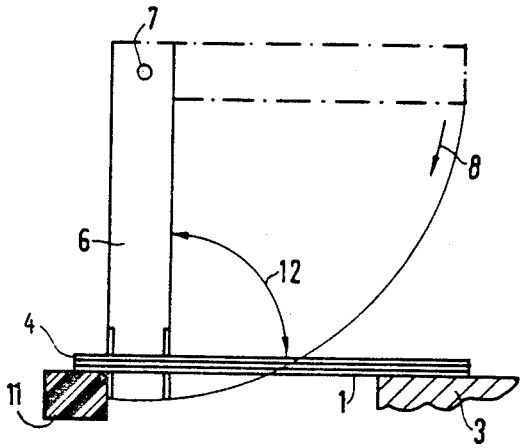
FIG. 1 is a side schematic view of a switch according to the invention in which the switch is depicted in its closed position.

The fixed blade contact 1 of an electric disconnect switch has a central slot 2 which is open on the end 4 of the blade contact 1 opposite to the fastening of the blade contact 1 to the switch housing 3. The blade contact 1 includes resilient contacts 5 located adjacent the end 4 which in the closed position of the switch laterally contact the switch blade 6. The switch blade 6 is movable about the fulcrum 7 which is located directly opposite or above the resilient contacts 5. In the open position of the disconnect switch, the switch blade 6 is above the blade contact 1, parallel thereto and on the same side of the blade contact 1 as the fulcrum 7, as indicated by dashed-dotted lines in FIG. 1.

Figure 2:
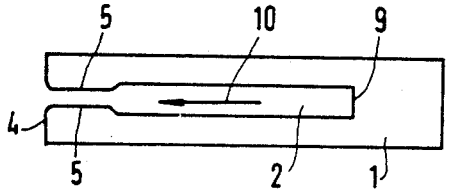
FIG. 2 is a top view of the blade contact of the switch of FIG. 1.

Upon closing the disconnect switch, the switch blade 6 moves in the direction of rotation indicated by the arrow 8 toward the blade contact 1 and enters the slot 2 from the closed side 9 of the blade contact. The entrance of the switch blade 6 into the blade contact proceeds from the closed side in the direction indicated in FIG. 2 by the arrow 10. In the closed position of the switch, the switch blade 6 in its end position is perpendicular to the blade contact 1 and rests against a stop 11 of insulating material arranged under the blade contact 1, i.e. on the side of the blade contact opposite to the fulcrum 7. The stop 11 is located beyond a change of direction of the switch blade in going from the open to the closed position of the switch. The stop 11, which does not interfere with the switching motion of the switch blade 6, assists the blade contact 1 by preventing flexing thereof, and in addition prevents forces indicated by the arrows 12 in FIG. 1 generated by a current loop which can exceed, particularly in the event of a short circuit, the friction forces of the adjacent resilient current contact 5, from rotating the switch blade 6 out of the blade contact 1.

Certain changes and modifications of the disclosed embodiments thereof, will be readily apparent to those skilled in the art. It is the applicants' intention to cover by their claims all those changes and modifications which could be made to the embodiments of the invention herein chosen for the purpose of disclosure without departing from the spirit and scope of the invention.

What is claimed is:

1. A disconnect or grounding switch comprising a knife blade pivotable about a fulcrum, a fixed blade contact disposed at a distance from the fulcrum less than the length of the knife blade, the knife blade being at an angle with or parallel to the fixed blade contact when the switch is in an open condition and perpendicular to the fixed blade contact when the switch is in a closed condition, the fixed blade contact having a central slot open at one end and closed at the other end, and spaced resilient current contacts formed by the slot in the fixed blade contact adjacent the open end of the slot, the knife blade being disposed in the slot perpendicular to the fixed blade contact in the closed condition of the switch with the resilient contacts laterally urged against the knife blade, wherein the improvement comprises:

the knife blade when the switch is in its open condition being on the same side of the fixed blade contact as the fulcrum, the knife blade when being pivoted about the fulcrum from the open to the closed condition of the switch entering the slot and moving into contact with the current contacts from the closed end of the slot, the switch further comprising an insulating stop disposed adjacent to the current contacts on the side of the fixed blade contact opposite to the fulcrum, the knife blade resting against the stop in the closed condition of the switch.

2. The switch according to claim 1 wherein the fulcrum is located generally along the longitudinal axis of the knife blade in the closed condition of the switch.

* * * * *